US007707658B2

(12) United States Patent
Culhane

(10) Patent No.: US 7,707,658 B2
(45) Date of Patent: May 4, 2010

(54) GARMENTS WITH STRETCH FABRICS

(75) Inventor: Steven D. Culhane, Sidney, NE (US)

(73) Assignee: Cabela's, Inc., Sidney, NE (US)

( * ) Notice: Subject to any disclaimer, the term of this patent is extended or adjusted under 35 U.S.C. 154(b) by 1477 days.

(21) Appl. No.: 10/106,681

(22) Filed: Mar. 22, 2002

(65) Prior Publication Data

US 2002/0138893 A1 Oct. 3, 2002

Related U.S. Application Data

(60) Provisional application No. 60/280,878, filed on Apr. 2, 2001.

(51) Int. Cl.
*A41D 1/06* (2006.01)

(52) U.S. Cl. ..... 2/227

(58) Field of Classification Search ..... 2/22–24, 2/62, 69, 79, 94, 227–233, 467, 465, DIG. 1, 2/16

See application file for complete search history.

(56) References Cited

U.S. PATENT DOCUMENTS

| | | | | | |
|---|---|---|---|---|---|
| 281,790 | A | * | 7/1883 | Pearson | 2/227 |
| 337,316 | A | * | 3/1886 | Erlanger | 2/231 |
| 765,181 | A | * | 7/1904 | Kempin | 2/227 |
| 1,071,483 | A | * | 8/1913 | Vance | 2/79 |
| 1,414,349 | A | * | 5/1922 | Hattie Fels | 2/79 |
| 1,578,970 | A | * | 3/1926 | Feser | 2/231 |
| 1,671,670 | A | * | 5/1928 | Chick | 2/230 |
| 1,789,784 | A | * | 1/1931 | Sneider | 2/227 |
| 1,838,022 | A | * | 12/1931 | Lieberman | 2/228 |
| 1,863,482 | A | * | 6/1932 | Isaacs | 2/228 |
| 2,032,982 | A | * | 3/1936 | Gerstman | 2/228 |
| 2,127,355 | A | * | 8/1938 | Grundstrom | 2/227 |
| 2,663,876 | A | * | 12/1953 | Miller et al. | 2/227 |
| 2,716,754 | A | * | 9/1955 | Hirsch | 2/227 |
| 2,812,516 | A | * | 11/1957 | Hoffman | 2/80 |
| 3,045,243 | A | * | 7/1962 | Lash et al. | 2/1 |
| 3,534,406 | A | * | 10/1970 | Barthlome | 2/2.12 |
| 4,091,464 | A | * | 5/1978 | Vykukal | 2/2.12 |
| 4,185,327 | A | * | 1/1980 | Markve | 2/458 |
| 4,240,158 | A | * | 12/1980 | de Polo | 2/227 |
| 4,357,714 | A | * | 11/1982 | Ito | 2/97 |
| D270,584 | S | * | 9/1983 | Ogden | D2/853 |
| 4,470,156 | A | * | 9/1984 | Duerbeck et al. | 2/227 |
| 4,488,314 | A | * | 12/1984 | Johnson | 2/23 |
| 4,509,213 | A | * | 4/1985 | Harvey | 2/22 |
| 4,608,716 | A | * | 9/1986 | Brumfield | 2/2.5 |
| 4,625,336 | A | * | 12/1986 | Derderian | 2/79 |
| 4,639,944 | A | * | 2/1987 | Lashley et al. | 2/456 |
| 4,688,269 | A | * | 8/1987 | Maeshima | 2/456 |
| 4,722,099 | A | * | 2/1988 | Kratz | 2/79 |
| 5,031,242 | A | * | 7/1991 | Aldridge et al. | 2/81 |
| 5,033,117 | A | * | 7/1991 | Fairweather | 2/69 |
| 5,038,408 | A | * | 8/1991 | DeBaene | 2/23 |
| 5,072,454 | A | * | 12/1991 | Trahan | 2/70 |

(Continued)

*Primary Examiner*—Alissa L Hoey
(74) *Attorney, Agent, or Firm*—Bachman & LaPointe, P.C.

(57) ABSTRACT

The present invention relates to various types of garments to be worn by outdoors people such as hunters and fishermen. The garments include stretch fabric portions in strategic locations to provide mobility as well as comfort and thereby allow the wearer to engage in a wide range of activities. The garments having such stretch fabric portions include pants-type garments, bib overall type garments, and coat-type garments and coverall-type garments.

8 Claims, 3 Drawing Sheets

U.S. PATENT DOCUMENTS

RE33,966 E * 6/1992 Robison ..... 2/82
5,163,183 A * 11/1992 Smith ..... 2/81
5,337,418 A * 8/1994 Kato et al. ..... 2/456
5,419,161 A * 5/1995 Bodenschatz et al. ..... 66/172 E
5,539,926 A * 7/1996 Mantos ..... 2/23
RE35,436 E * 2/1997 Grilliot et al. ..... 2/93
5,659,895 A * 8/1997 Ford, Jr. ..... 2/2.11
5,737,773 A * 4/1998 Dicker et al. ..... 2/69
5,864,888 A * 2/1999 Archer ..... 2/227
5,896,582 A * 4/1999 Baacke et al. ..... 2/79
5,901,374 A * 5/1999 Foster ..... 2/82
5,918,319 A * 7/1999 Baxter ..... 2/455
5,926,856 A * 7/1999 Duval ..... 2/455
5,937,441 A * 8/1999 Raines ..... 2/69
6,053,852 A * 4/2000 Wilkinson ..... 482/127
6,119,274 A * 9/2000 Graham ..... 2/242
6,279,161 B1 * 8/2001 Johnston ..... 2/69
6,311,333 B1 * 11/2001 Batra ..... 2/237
6,473,908 B1 * 11/2002 Bontems ..... 2/227
6,543,062 B1 * 4/2003 Amsel et al. ..... 2/227

* cited by examiner

GARMENTS WITH STRETCH FABRICS

CROSS-REFERENCE TO RELATED APPLICATION(S)

This application claims the benefit of U.S. Provisional Patent Application No. 60/280,878, filed Apr. 2, 2001, entitled GARMENTS WITH STRETCH FABRICS.

BACKGROUND OF THE INVENTION

The present invention relates to garments to be worn by outdoors people, such as hunters and fishermen, which provide comfort and most importantly mobility. The garments include portions formed from stretch fabrics.

Outdoorsmen, such as hunters and fishermen, frequently find themselves in situations which require extreme mobility. For example, an outdoorsmen may find it necessary to climb a tree. A hunter may find himself or herself in a position where they need mobility in their clothing to allow them to swing a rifle or pull a bow string. Fishermen may find themselves in a position where they need mobility to cast a fishing line. Clothes worn by hunters and fishermen today lack the required mobility.

SUMMARY OF THE INVENTION

Accordingly, it is an object of the present invention to provide garments which have a high degree of mobility in areas where mobility is needed.

It is a further object of the present invention to provide garments which are comfortable to wear.

It is yet a further object of the present invention to provide garments of a type which can be worn by both men and women.

The foregoing objects are attained by the garments of the present invention.

In accordance with a first embodiment of the present invention, a garment is provided which comprises first and second leg portions with each of the leg portions having an articulated knee portion and a hinged knee portion. Both the articulated knee portion and the hinged knee portion are formed from a stretch material, wherein the stretch material forming the articulated knee portion has a longer span than the stretch material forming the hinged knee portion. The garment further has a seat portion formed from a stretch material. The garment may comprise pants or a bib overall.

In a second embodiment of the present invention, a garment is provided which has a body portion and two arm portions extending from the body portion with each arm portion having an elbow portion formed from a stretch material. The body portion has a rear portion which is also formed from a stretch fabric material. Still further, the garment includes under arm portions formed from a stretch fabric material.

Other details of the garments of the present invention, as well as other objects and advantages attendant thereto, are set forth in the following description and the accompanying drawings wherein like reference numerals depict like elements.

BRIEF DESCRIPTION OF THE DRAWING(S)

DETAILED DESCRIPTION OF THE PREFERRED EMBODIMENT(S)

Figure 1:
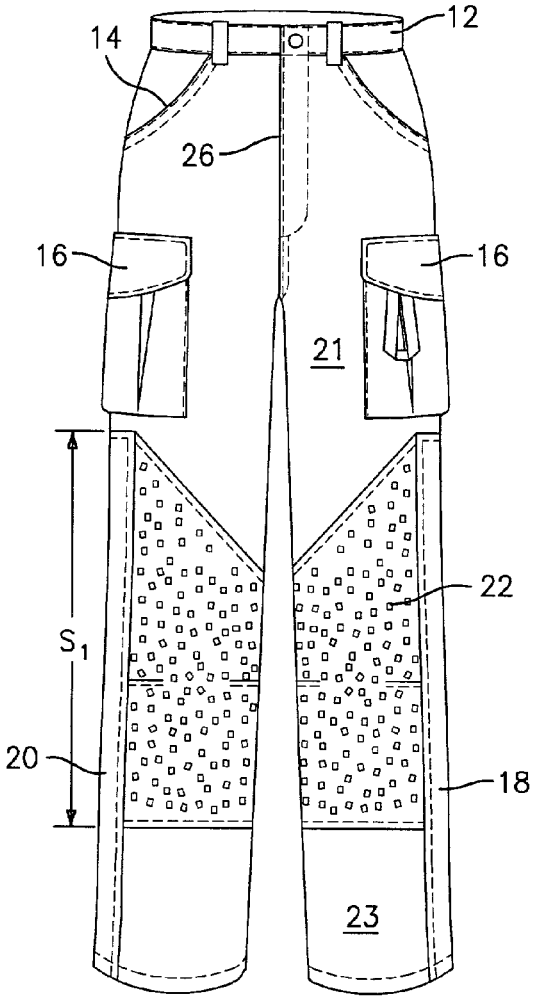
FIG. 1 is a front view of a pants garment formed in accordance with the present invention.
Figure 2:
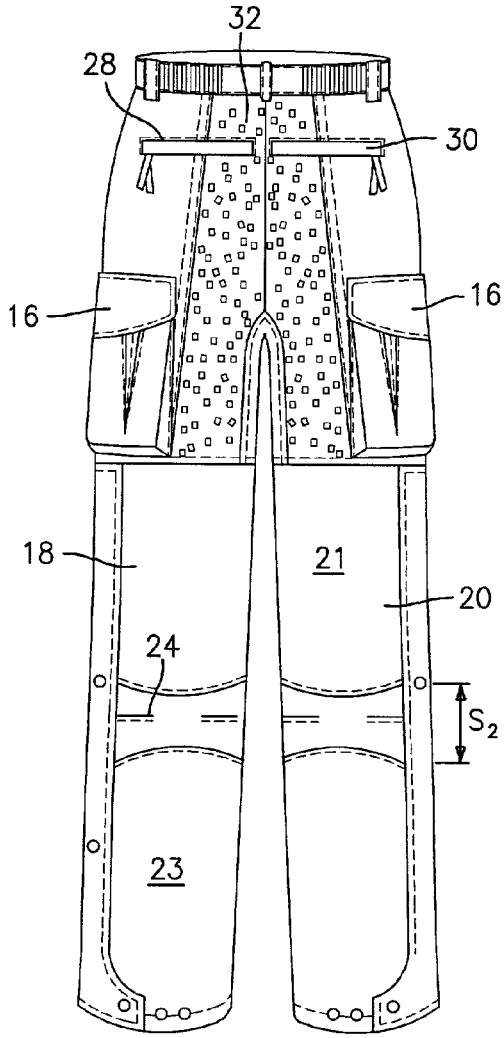
FIG. 2 is a rear view of the pants garment of FIG. 1.

Referring now to the drawings, FIGS. 1 and 2 illustrate a pants garment 10 formed in accordance with the present invention. The pants garment 10 includes a waist portion 12, front pockets 14 and 16, rear pockets 28 and 30, and legs 18 and 20 having an articulated knee portion 22 and a hinge knee portion 24. The pants garment 10 also includes an opening 26 in the front of the garment 10. The opening 26 may be closed by any suitable means known in the art, such as a zipper, snaps, buttons, and/or VELCRO pieces. Still further, the pants garment 10 includes a seat portion 32. The waist portion 12 may contain an elastic material and a snap- or hook-type closure for allowing a tight fit around a user's waist.

As previously discussed, outdoorsmen often find themselves in situations where it is necessary to climb trees or fences or otherwise jump over or hurdle terrain features. In order to allow the user freedom to accomplish these tasks and others, the pants garment 10 must provide mobility as well as comfort. To this end, the articulated knee portion 22 and/or the hinged knee portion 24 are formed from a stretch fabric material. As can be seen from FIGS. 1 and 2, when both the articulated knee portion 22 and the hinged knee portion 24 are both formed from a stretch fabric material, it is preferred that the stretch fabric material forming the articulated knee portion 22 has a larger span $S_1$ than the stretch fabric material forming the hinged knee portion 24. This is to allow a greater range of stretching in the front where it is needed. In the rear of the garment 10, the knee portion 24 primarily acts as a hinge and thus, a smaller span $S_2$ of stretch fabric material is needed for this portion. Remaining portions of the legs, such as upper leg portions 21 and lower leg portions 23, are preferably formed from a non-stretch or stable fabric material.

In addition to the knee portions 22 and 24 being formed from a stretch fabric material, the seat portion 32 of the pants garment 10 is formed from a stretch fabric material. This provides added mobility during bending.

The stretch fabric material used to form the knee portions 22 and 24 and the seat portion 32 may be any suitable stretch fabric material known in the art, such as a SPANDEX fabric material.

Figure 3:
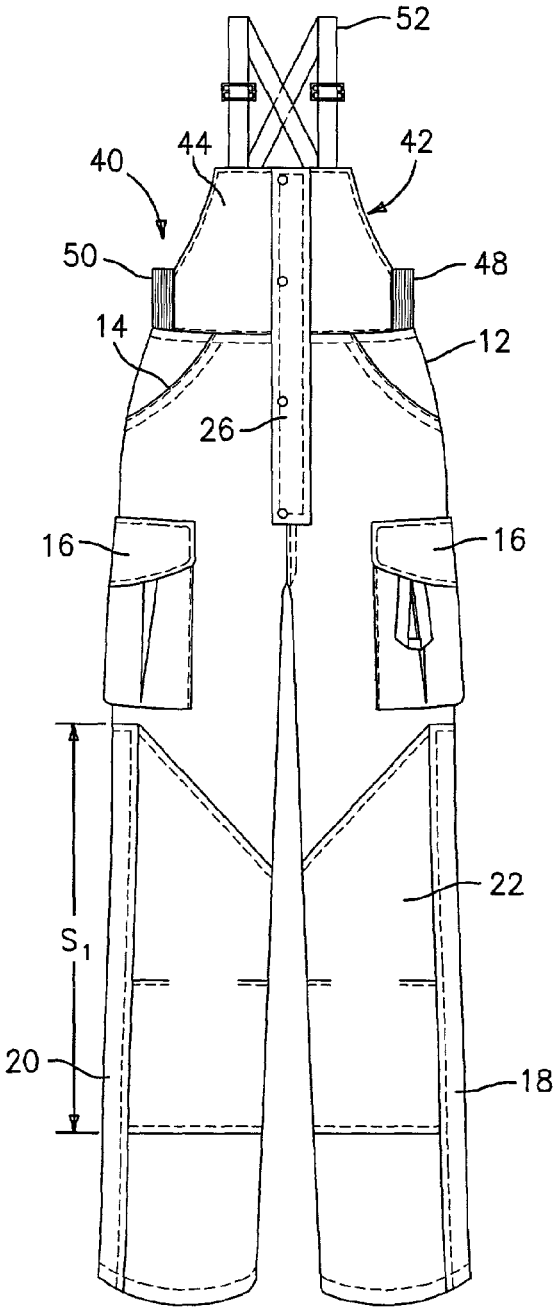
FIG. 3 is a front view of a bib overall garment formed in accordance with the present invention.
Figure 4:
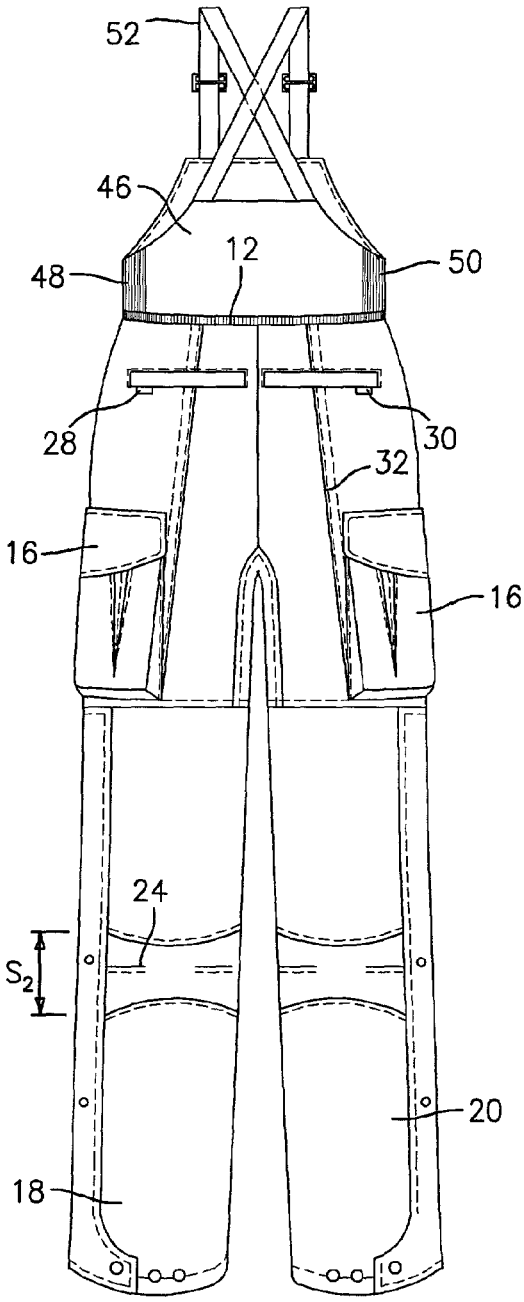
FIG. 4 is a rear view of the bib overall garment of FIG. 3.

Referring now to FIGS. 3 and 4, a bib overall type garment 40 is illustrated. The garment 40 is similar in construction to the pants garment 10 and includes a waist portion 12, front pockets 14 and 16, legs 18 and 20, articulated knee portion 22, hinged knee portion 24, a front opening 26, rear pockets 28 and 30, and seat portion 32. As before, the waist portion 12 is preferably elasticized and the front opening 26 has a closure such as a zipper, snaps, VELCRO pieces and/or buttons.

The bib garment 40 also has knee portions 22 and 24 and a seat portion 32 formed from a stretch fabric material and remaining portions, such as upper leg portions 21 and lower leg portions 23, formed from non-stretch or stable fabrics. In addition, the garment 40 has a bib portion 42 with front and rear panels 44 and 46 respectively. The front and rear panels 44 and 46 are joined together by side panels 48 and 50 and by straps 52. The side panels 48 and 50 may be joined to the front and rear panels 44 and 46 using any suitable means known in the art. If desired, the straps 52 may include buckle-type release devices to facilitate a user's access into and out of the garment 40. Further, the straps 52 may be variable in length and may be provided with suitable length adjustment devices.

In a preferred construction, the side panels 44 and 46 and the straps 52 are formed from a stretch fabric material. As before, the material forming the side panels 44 and 46 and the straps 52 may comprise any suitable stretch fabric material known in the art.

Figure 5:
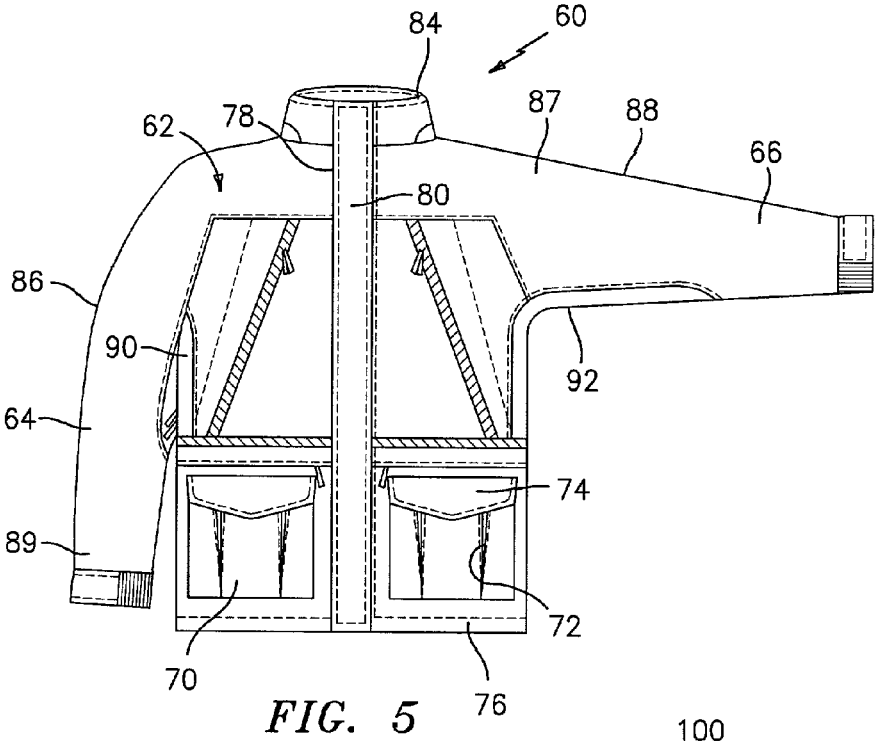
FIG. 5 is a front view of a coat formed in accordance with the present invention.
Figure 7:
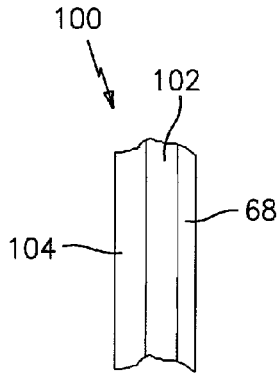
FIG. 7 is a sectional view if a portion of the coat of FIG. 5.
Figure 6:
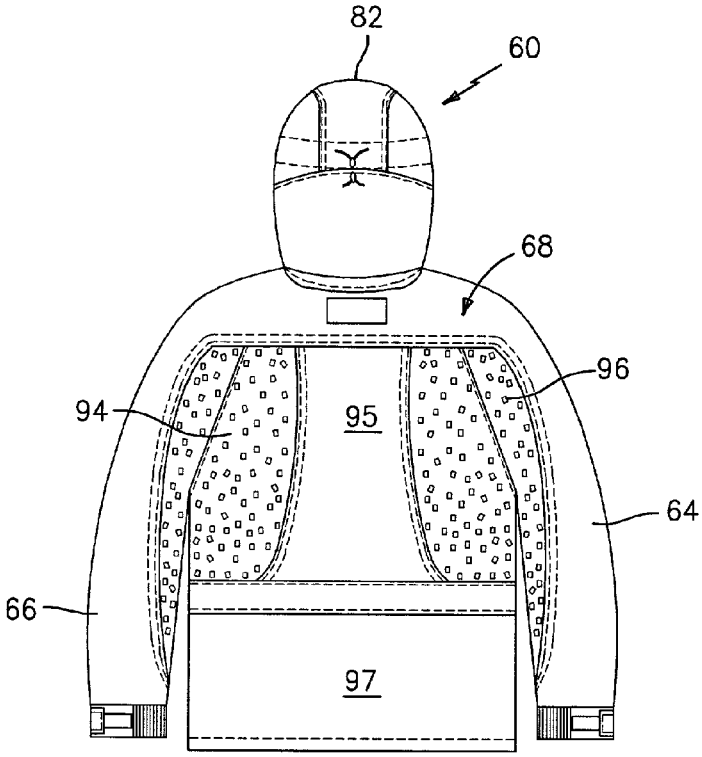
FIG. 6 is a rear view of the coat of FIG. 5.

Referring now to FIGS. 5-7, a coat garment 60 is illustrated. The coat garment 60 includes a front portion 62, arms 64 and 66, and a rear portion 68. The coat garment 60 may include any desired number of pockets such as pockets 70 and 72. The pockets may be open pockets are pockets which are capable of being closed by a button, a zipper, VELCRO fabric pieces, snaps, or the like. If desired, the pockets 70 and 72 may have flap portions 74. The waist portion 76 of the garment 60 may have a drawstring or the like to allow this portion to be closely fitted to the user.

The garment 60 also has a front opening 78. The front opening 78 may be closed using any suitable means known in the art such as a zipper, VELCRO pieces, snaps, and/or buttons. If desired, the garment 60 may be constructed so that a piece of fabric 80 overlaps the closure device.

The garment 60 may also have a hood 82 attached to it. The hood 82 may be collapsible so that it can be stored in a neck portion 84 of the garment 60. Alternatively, the hood 82 may be detachable from the garment 60.

To provide the garment 60 with the mobility need by a user, certain portions of the garment 60 are formed from a stretch fabric material, while other portions are formed from a non-stretch or stable fabric material. For example, elbow portions 86 and 88, and under arm portions 90 and 92 of the garment 60 are formed from a stretch fabric material. Upper arm portions 87 and wrist portions 89 of the garment 60 may be formed from non-stretch or stable fabric material. Further, the rear portion 68 has first and second side panels 94 and 96 formed from a stretch fabric material, while a central portion 95 and a lower rear portion 97 are formed from a non-stretch or stable fabric material. As before, the stretch fabric material forming the elbow portions 86 and 88, underarm portions 90 and 92, and side portions 94 and 96 may comprise any suitable stretch fabric material known in the art. By providing a stretch fabric material in these portions, a user is free to engage in a wide range of activities requiring freedom of movement such as drawing a bow string or swinging a rifle or a shotgun to a desired position.

If desired, the entire rear portion 68 of the garment 60 may be formed from a stretch fabric.

If desired, the garment 60 may include a liner 100. The liner 100 may be a removable liner or a permanently affixed liner. Preferably, when present, the liner 100 is formed from a stretch fabric material such as a breathable, waterproof stretch fabric material 102. If desired, the stretch fabric material 102 could be part of a laminated construction where a stretch film material 104 is applied to one side of the stretch fabric material. Ideally, the stretch fabric material 102 would be a four way stretch fabric material.

While the garment 60 has been illustrated as being a jacket type of garment, it could also be a parka type of garment if desired.

It should be recognized that the garments described herein may be adapted and/or sized to fit men, women, and children.

Further, the stretch fabric material locations set forth hereinbefore in connection with the pants and the coat garments could be used in the construction of a single piece coverall type of garment which covers both the upper and lower portions of a human torso.

If desired, both the stretch fabric materials and the non-stretch or stable fabric materials used in the garments of the present invention may be coated or laminated with qa coating or film that make them waterproof.

It is apparent that there has been provided in accordance with the present invention garments made with stretch fabrics which fully satisfy the objects, means, and advantages set forth hereinbefore. While the invention has been described in the context of specific embodiments thereof, alternatives, modifications, and variations will become apparent to those skilled in the art having read the foregoing description. Accordingly, it is intended to embrace those alternatives, modifications, and variations as fall within the broad scope of the appended claims.

What is claimed is:

1. A garment to be worn by a human being comprising:

a waist portion and a pair of legs extending downwardly from said waist portion;

each of said legs having an articulated knee portion and a hinged knee portion;

both the articulated knee portion and the hinged knee portion being formed from a stretch fabric material;

said stretch fabric material forming the articulated knee portion having a span greater than a span of the stretch fabric material forming the hinged knee portion;

other portions of said legs being formed by a non-stretch fabric material; and a seat portion formed from a stretch fabric material.

2. A garment according to claim 1, further comprising at least one pocket, a front opening, and closure means for said front opening.

3. A garment according to claim 1, wherein said garment is a pair of pants.

4. A garment according to claim 1, wherein said garment comprises a bib overall type garment and has a front panel and a rear panel joined together by two side panels.

5. A garment according to claim 4, wherein each of said side panels is formed from a stretch fabric material.

6. A garment according to claim 5, further comprising a pair of straps connected to said rear and front panels.

7. A garment according to claim 1, wherein said waist portion contains an elastic material and a closure for allowing a tight fit around a user's waist.

8. A garment according to claim 1, further comprising a pair of pockets attached to a front portion of said garment and said articulated knee portions extending from a region immediately below said pockets to a portion below a user's knees.

* * * * *